US006923530B2

(12) United States Patent
Anderson et al.

(10) Patent No.: US 6,923,530 B2
(45) Date of Patent: Aug. 2, 2005

(54) FUSED FILTER SCREEN FOR USE IN INK JET CARTRIDGE AND METHOD OF ASSEMBLING SAME

(75) Inventors: Stephen A. Anderson, Thompson Station, TN (US); Patrick D. Carter, Rochester, NY (US); Bruce S. Jones, Franklin, TN (US)

(73) Assignee: Nu-Kote International, Inc., Dallas, TX (US)

( * ) Notice: Subject to any disclaimer, the term of this patent is extended or adjusted under 35 U.S.C. 154(b) by 0 days.

(21) Appl. No.: 10/170,480

(22) Filed: Jun. 13, 2002

(65) Prior Publication Data

US 2002/0191058 A1 Dec. 19, 2002

Related U.S. Application Data

(60) Provisional application No. 60/298,050, filed on Jun. 13, 2001, provisional application No. 60/298,042, filed on Jun. 13, 2001, and provisional application No. 60/298,036, filed on Jun. 13, 2001.

(51) Int. Cl.[7] ..... B41J 2/175
(52) U.S. Cl. ..... 347/86
(58) Field of Search ..... 347/84–87

(56) References Cited

U.S. PATENT DOCUMENTS

| | | | |
|---|---|---|---|
| 3,967,286 | A | 6/1976 | Andersson et al. |
| 4,005,440 | A | 1/1977 | Amberntsson et al. |
| 4,015,271 | A | 3/1977 | Sultan |
| 4,095,237 | A | 6/1978 | Amberntsson et al. |
| 4,279,519 | A | 7/1981 | Shiurila |
| 4,336,767 | A | 6/1982 | Wada |
| 4,400,102 | A | 8/1983 | Shiurila et al. |
| 4,403,874 | A | 9/1983 | Payne et al. |
| 4,579,468 | A | 4/1986 | Gomi et al. |
| 4,771,298 | A | 9/1988 | Lee et al. |

(Continued)

FOREIGN PATENT DOCUMENTS

| | | |
|---|---|---|
| EP | 0 529 879 A1 | 3/1993 |
| EP | 0 624 475 B1 | 11/1994 |
| EP | 0 624 475 A3 | 11/1994 |
| EP | 0 624 475 A2 | 11/1994 |
| EP | 0 633 138 A3 | 1/1995 |
| EP | 0 633 138 A2 | 1/1995 |
| EP | 0 635 373 A1 | 1/1995 |
| EP | 0 647 527 A1 | 4/1995 |

OTHER PUBLICATIONS

Patent Abstracts of Japan—Pub. No. 59143646—Pub. Date Aug. 17, 1984.

*Primary Examiner*—Stephen D. Meier
*Assistant Examiner*—An H. Do
(74) *Attorney, Agent, or Firm*—Fay Sharpe Fagan Minnich & McKee

(57) ABSTRACT

An ink tank cartridge includes a housing having a chamber in which ink is stored. A screen is secured to a surface of the housing through which an outlet passage communicates with the chamber. The screen is fused to the first surface by melting a continuous portion or bead around the outlet passage with a heated ram, ultrasonic welding, laser welding, etc. A vacuum can be applied through the outlet port to assist in locating and removing wrinkles from the screen. A recess can also be provided in the first surface of the housing to locate the screen and allow the ink absorbing member, filled with ink, to form a liquid-tight seal with the remainder of the first surface about the recess.

4 Claims, 3 Drawing Sheets

U.S. PATENT DOCUMENTS 5,025,271 A 6/1991 Baker et al.
5,084,713 A 1/1992 Wong
5,156,471 A 10/1992 Suzuki et al.
5,174,665 A 12/1992 Suzuki et al.
5,317,339 A * 5/1994 Braun et al. ..... 347/87
D351,190 S 10/1994 Oshima et al.
5,363,130 A 11/1994 Cowger et al.
5,444,474 A 8/1995 Ohtsubo et al.
5,477,963 A 12/1995 Mochizuki et al.
D369,383 S 4/1996 Miyazawa et al.
5,560,720 A 10/1996 Suzuki et al.
5,576,749 A 11/1996 Mochizuki et al.
5,590,510 A 1/1997 Mochizuki et al.
5,603,577 A 2/1997 Suzuki et al.
5,607,242 A 3/1997 Suzuki et al.
5,615,957 A 4/1997 Suzuki et al.
5,622,439 A 4/1997 Suzuki et al.
D381,039 S 7/1997 Shinada et al.
D389,180 S 1/1998 Miyazawa et al.
D390,598 S 2/1998 Miyazawa et al.
5,790,158 A 8/1998 Shinada et al.
5,821,965 A 10/1998 Oda et al.
5,875,615 A 3/1999 Ito et al.
5,950,403 A 9/1999 Yamaguchi et al.
6,045,207 A 4/2000 Mochizuki et al.
6,048,056 A 4/2000 Hotomi
6,058,984 A 5/2000 Sato
D427,236 S 6/2000 Shinada et al.
6,086,193 A 7/2000 Shimada et al.
6,123,469 A 9/2000 Suzuki et al.
6,145,974 A 11/2000 Shinada et al.
6,170,941 B1 1/2001 Hara et al.
6,238,042 B1 5/2001 Kobayashi et al.
6,325,499 B1 12/2001 Betschon
6,444,331 B2 * 9/2002 Ritter et al. ..... 428/553
6,513,920 B1 * 2/2003 Deshmukh et al. ..... 347/92
6,659,599 B2 * 12/2003 Putman et al. ..... 347/86

* cited by examiner

FUSED FILTER SCREEN FOR USE IN INK JET CARTRIDGE AND METHOD OF ASSEMBLING SAME

CROSS-REFERENCE TO RELATED APPLICATIONS

This application claims priority from provisional application Ser. Nos. 60/298,036, filed Jun. 13, 2001; 60/298,042, filed Jun. 13, 2001; and 60/298,050, filed Jun. 13, 2001.

BACKGROUND OF THE INVENTION

This application relates to an ink jet cartridge or cassette as used in an ink jet printer, and more particularly to an apparatus and method for reducing the introduction of air into the system. It will be appreciated, however, that the invention may find application in related environments and applications that encounter these same issues.

It is generally known in the art to form a cartridge housing or body from a plastic material. The housing includes one or more cavities or chambers that hold a predetermined supply of ink. For example, a single color of ink may be provided in a single chamber cartridge or multiple chambers may be provided, for example, each holding a different color ink stored therein for selective use in a color printer. It is also generally known to provide an ink absorbing member such as a reticulated polyethylene or melamine foam that fits within the chamber(s). In some arrangements, the ink absorbing member fills the substantial entirety of the chamber, while in other instances a portion of the ink supply is free ink and the remainder is stored in the ink absorbing member. One or more outlet ports communicate with the respective one or more chambers through outlet passages. The outlet passage proceeds through a first or bottom wall of the housing. A supply needle from an associated printer extends through the outlet port and thus conveys ink from the housing to a recording head or printhead.

Print quality can be adversely effected by the introduction of air into the ink chamber, outlet passage, or outlet port. Thus, manufacturers of ink cartridges are careful in the design and assembly, i.e., filling, to limit the potential for air introduction into the system. One area of potential air introduction is between the chamber and outlet passage. It is common to employ a filter or screen, such as a woven plastic mesh filter, between the ink absorbing member and the outlet passage. The screen prevents contaminants from reaching the printhead from the ink jet cartridge and also aids in maintaining capillary flow from the chamber to the printhead. During assembly, any wrinkles or mis-positioning of the screen can result in print quality problems such as voids or ink starvation. Thus, a need exists to improve print quality and particularly limit the potential for air bypassing the screen as ink proceeds from the housing chamber to the outlet port.

SUMMARY OF THE INVENTION

The present invention provides an ink cartridge in which the screen is fused in sealed relation to the housing over the outlet passage.

The ink cartridge includes a housing having a chamber adapted to receive ink and a first surface having an outlet passage communicating with the chamber and through which ink is selectively dispensed. A screen is received in the housing and a portion of the screen fused in a sealed relation to the housing in a continuous path around the outlet passage.

The screen is a plastic woven mesh material that is fused adjacent its periphery to the first surface.

A recess is provided in the first surface to locate the screen and allows the ink absorbing member to form a fluid seal with the first surface.

According to a method of assembly, the screen is located in overlying relation with the outlet passage and a portion is fused in sealing relation to the cartridge.

A fusing step can be one of ultrasonically welding, laser welding, or melting the screen to the ink cartridge around the outlet passage.

The method can also include the step of applying a vacuum to the outlet passage to maintain the screen in position.

A primary advantage of the invention resides in the improved print quality that results.

Another advantage of the invention relates to the improved ability to prevent contaminants from reaching the printhead.

Still another advantage is found in the reduction of air introduced into the print system.

A still further advantage resides in the ease and inexpense at which such improvements are achieved.

Still other advantages and benefits of the invention will become apparent to those skilled in the art upon reading and understanding the following detailed description.

BRIEF DESCRIPTION OF THE DRAWINGS

The invention may take form in certain components, structures, and steps, preferred embodiments of which will be illustrated in the accompanying drawings.

DETAILED DESCRIPTION OF THE INVENTION

Figure 2:
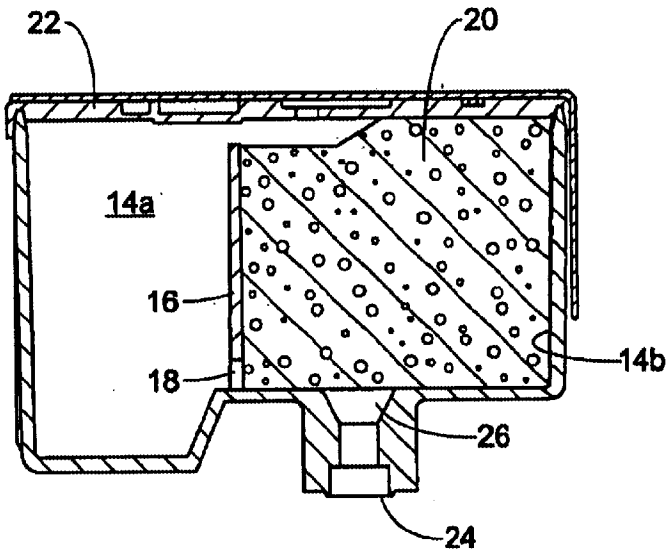
FIG. 2 is a cross-sectional view of an assembled cartridge.
Figure 1:
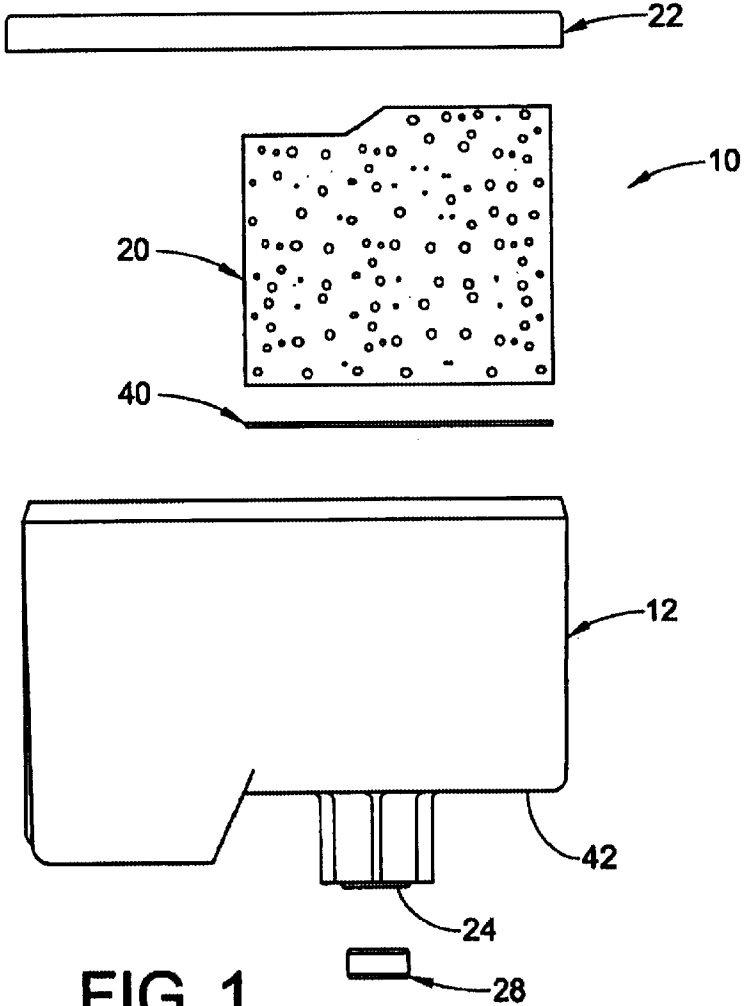
FIG. 1 is an exploded view of an ink jet cartridge.

As illustrated in FIGS. 1 and 2, an ink jet cassette or cartridge 10 includes a housing 12 having an internal chamber or cavity 14 (FIG. 2). As shown here, the housing interior is divided into two chambers 14*a*, 14*b* by a dividing wall 16. It will be appreciated, however, that the housing may have one chamber, or multiple chambers. For example, the cartridge may be partially free ink/partially foam design, or the cartridge may be a single color versus multi-color cartridge. The invention should not however be limited to a single or multi-chamber arrangement. In the partial free ink/partial foam design, a passageway 18 is provided in a base portion of the dividing wall to allow ink to migrate from the free ink side to an ink absorbing member 20. The ink absorbing member is typically a block of porous material or foam such as a reticulated polymer foam or melamine foam, or other conventional ink absorbing member used to store ink within the pores thereof. As shown in FIG. 2, with the partial free ink/partial foam design, the ink absorbing member 20 substantially fills the entire chamber 14*b* on the foam side of the cartridge. In other designs that do not employ free ink, the ink absorbing member will fill substantially the entire cavity or portions of a chamber. Again, the invention should not be so limited to any one of these designs.

A lid or cover 22 is received over a first or upper end of the housing and typically sealingly secured in place. For example, the cover may be ultrasonically welded along a peripheral portion to the cartridge housing to seal the components together. An ink outlet port 24 communicates via an outlet passage 26 with the chamber of the cartridge. In this manner, ink flows from the ink chamber through the outlet passage and ultimately reaches the outlet port 24. The outlet port receives an elastomeric grommet member 28 that is selectively pierced by a needle from an associated printer (not shown) to establish communication through the outlet port with the outlet passage 26 in a manner generally well known in the art.

Figure 3:
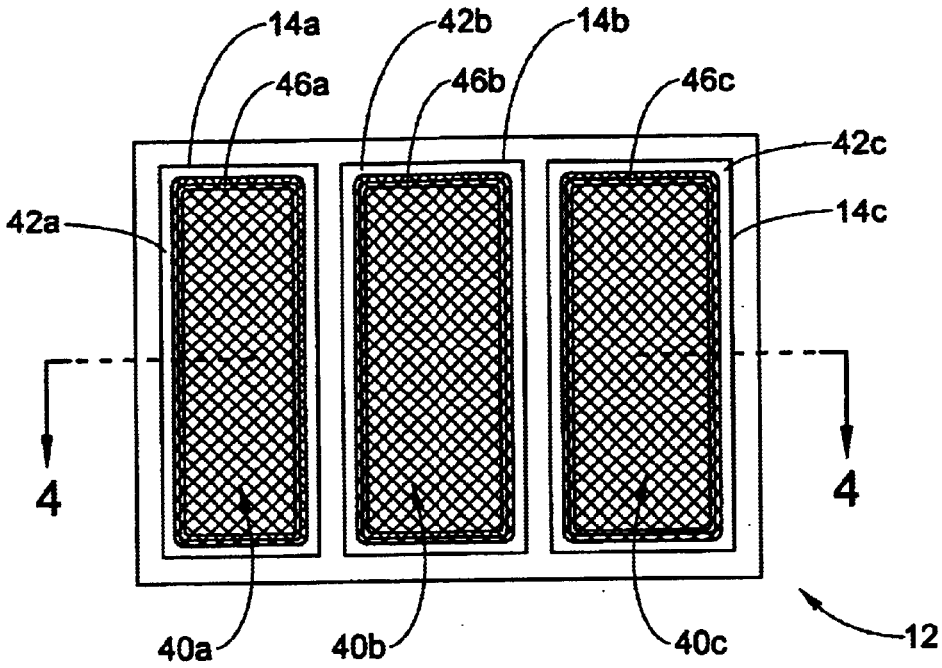
FIG. 3 is a plan view with a top removed from the cartridge.
Figure 4:
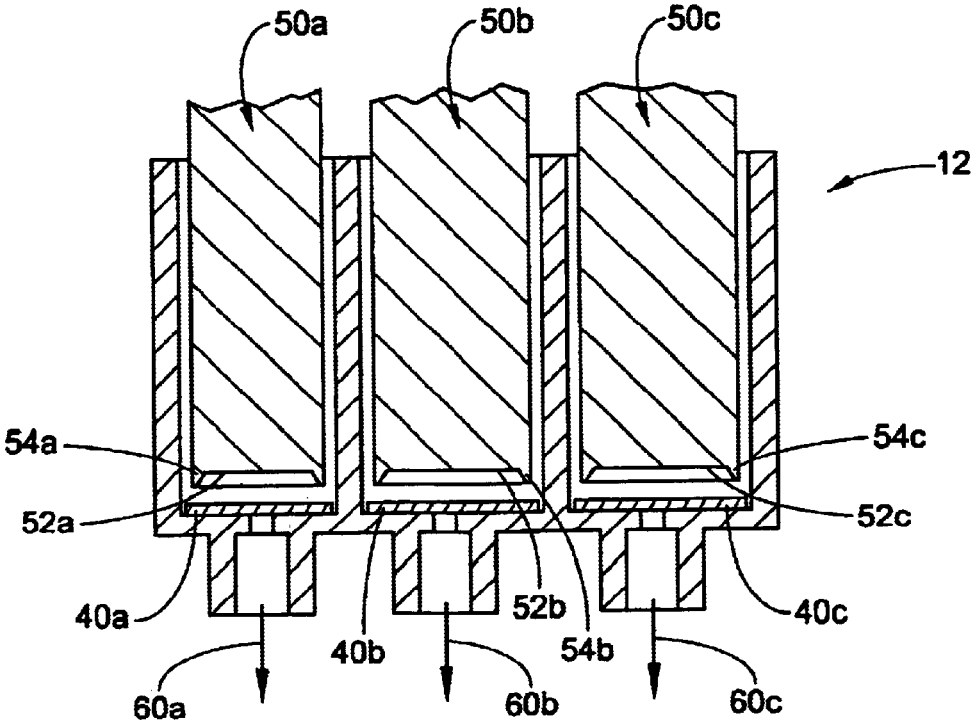
FIG. 4 is a cross-sectional view taken generally along the lines 4—4 of FIG. 3 and illustrating the advancement of rams into the housing cavities.

Disposed between the outlet passage and the housing chamber is a filter or screen 40. Preferably, the screen is a woven plastic mesh filter material. Three separate screens are shown in FIGS. 3 and 4 and identified as 40*a*, 40*b*, 40*c*. In an embodiment of the invention, the screens have an elongated rectangular conformation (FIG. 3) that substantially overlay first or lower surfaces 42*a*, 42*b*, 42*c* of the catridge. Each screen 40*a*, 40*b*, 40*c* is substantially dimensioned to entirely overlay each outlet passage (it being understood that an outlet passage is provided for each chamber 14*a*, 14*b*, 14*c* of the housing, and thus a separate screen for each chamber). The screen is preferably interposed between the ink absorbing member 20 and the respective outlet passage and it is desirable, as noted above, that the screen be accurately positioned and any wrinkles eliminated to overcome potential print quality problems.

According to the present invention, the screens are secured to the housing, particularly the first surfaces 42*a*, 42*b*, 42*c* through which the outlet passages communicate with the housing chamber. Preferably, a portion of each screen is fused to the cartridge housing. Here, the fused portion is a perimeter or peripheral portion of the screen designated by reference numerals 46*a*, 46*b*, 46*c*. The fused portion entirely circumscribes or defines a continuous path sealed about the outlet passage so that any ink in the housing must pass through the screen before reaching an outlet passage. Each screen is placed in mating, planar relation with the firat surface of the housing and maintained in mating planar relation while the fusing takes place.

As particularly illustrated in FIG. 4, one method of securing the screens to the housing employs rams 50*a*, 50*b*, 50*c*. The rams are either individually operated or are interconnected so that the separate ram portions operate as a unit. Each ram preferably has a recess 52*a*, 52*b*, 52*c* in a first or lower face thereof so that a perimeter portion 54*a*, 54*b*, 54*c* contacts the respective screen. The ram is heated and abuttingly engages the screen against the first surface. As a result of this engagement, a bead of melted material at the peripheral portion 46*a*, 46*b*, 46*c* is formed to fuse the screen to the cartridge housing.

Other alternative means of securing or fusing the screens to the first surface may be used. For example, a bead of melted material may be formed by ultrasonically welding the plastic screen to the plastic first surface of the housing. Laser welding could also be used to secure the components together. No matter which particular securing method is used, it is important that the screen be maintained in a planar relationship, i.e., wrinkle free and completely secured around the outlet passage, so that the ink must flow through the screen before reaching the respective outlet passage.

As represented in FIG. 4, reference arrows and reference numerals 60*a*, 60*b*, 60*c* represent the application of a vacuum force through the outlet passage/outlet port to maintain the screen in place. Thus, while the heated ram is advanced into the chamber of the housing, the vacuum applies a temporary holding force that holds the screen in planar, wrinkle-free condition against the first surface. Once the fusing process is complete, the vacuum is removed and remaining assembly steps of the ink jet cartridge proceed.

Figure 5:
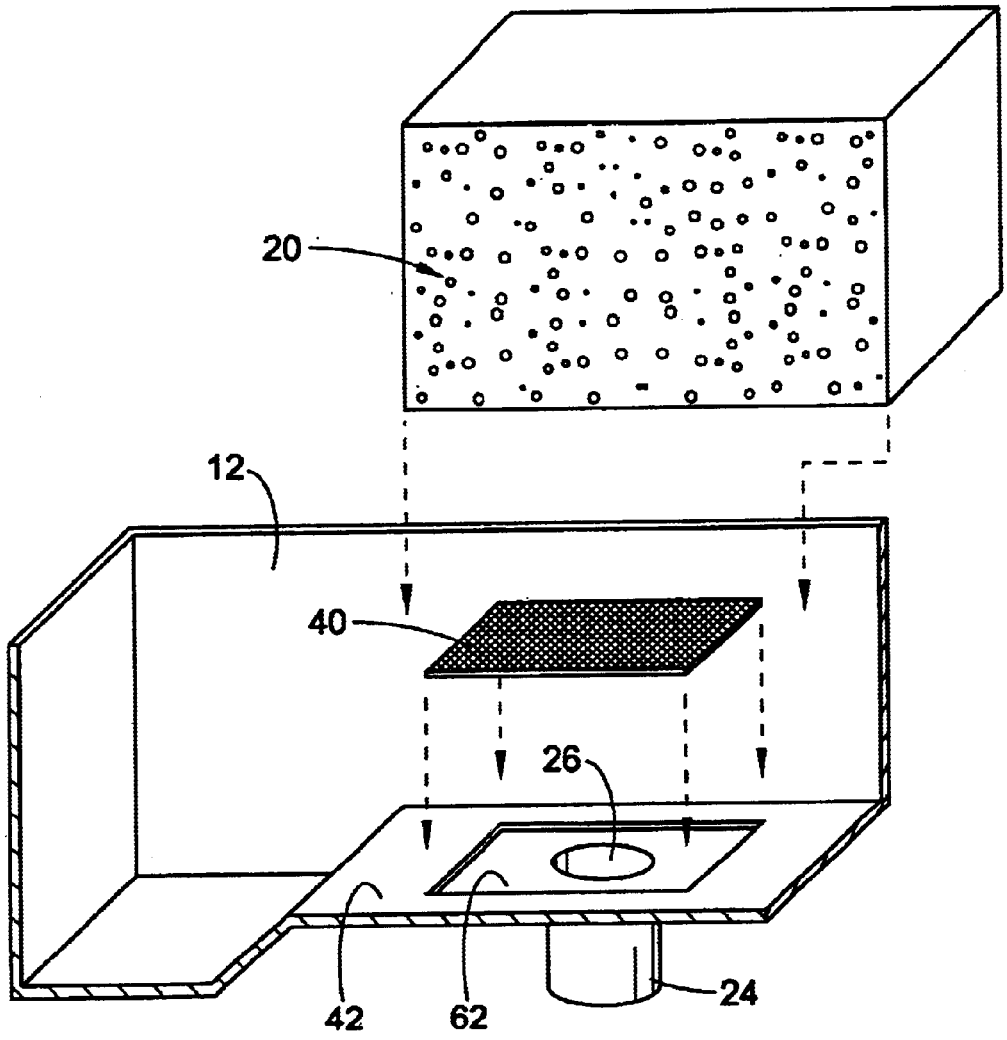
FIG. 5 is an exploded view, partially cut away illustrating the assembly of components.

As additionally shown in FIG. 5, the first surface 42 is modified to include a recess 62. Here, the recess is dimensioned to matingly receive the screen therein. Once positioned in the recess, the screen is essentially flush with the remainder of the first surface of the chamber. This arrangement helps to locate, as well as hold the screen in the desired position during the fusing process.

Once the screen is secured in place, contaminants are effectively filtered from the ink as it proceeds to the printhead. The screen also aids in capillary flow and the above-described structure assists in maintaining such capillary flow since angles and deformities in the screen are eliminated. The continuous melt bead of material around the outer edges of the screens forces the ink to pass through the screen instead of allowing it to pass along the outer edges before reaching the outlet ports. Using a vacuum assist through the outlet ports aids in pulling the screens into a flat, planar condition as the heated ram melts the thin seam around the edges of the screen. The outlet ports may be modified with rubber vacuum cups or other associated structure in order to apply the desired vacuum which forces the screen to adopt a planar configuration. Once positioned in place, a machine operator actuates a cycle in which the ram is advanced into the housing cavity (e.g., via air cylinder) with a preset pressure whereby the heated ram melts the edges of the screen for a predetermined time and at a predetermined temperature. Once the cycle is complete, the casing is removed and the cartridge is prepared for insertion of the ink absorbing member.

It will also be noted that the remainder of the first surface is generally planar around the recess so that once the ink absorbing member is inserted into the housing chamber, it contacts the first surface around the screen and establishes an air-tight seal when filled with ink. This allows the printer to have increased priming ability and suction to the ink in the foam without permitting air to be pulled below the screen. Once the foam is filled with ink, the surface tension of the fluid combined with the surrounding first surface creates an air-tight seal. The priming mechanism in the printer can create a sufficiently high suction and yet air cannot follow a path beneath the screen that would otherwise potentially create voids. A liquid barrier is established as the wetted foam contacts the smooth first surface of the cartridge and surrounds the recessed region.

The application has been described with reference to the preferred embodiments. Obviously, alterations and modifications will occur to others upon a reading and understanding of the specification. It is intended to include all such modifications and alterations insofar as the come within the scope of the appended claims or the equivalents thereof.

Having thus described the invention, we claim:

1. A method of assembling an ink cartridge that has a chamber for receiving ink therein and an outlet passage communicating with the chamber through which ink is selectively dispensed, and a screen for filtering ink before the ink passes through the outlet passage, the method comprising the steps of:

locating the screen in overlying relation with the outlet passage;

fusing a portion of the screen in sealing relation to the ink cartridge;

advancing a ram into the chamber toward the outlet passage;

urging the screen against the ink cartridge adjacent the outlet passage; and heating the ram to fuse the screen to the ink cartridge around the outlet passage.

2. A method of assembling an ink cartridge that has a chamber for receiving ink therein and an outlet passage communicating with the chamber through which ink is selectively dispensed, and a screen for filtering ink before the ink passes through the outlet passage, the method comprising the steps of:

locating the screen in overlying relation with the outlet passage;

fusing a portion of the screen in sealing relation to the ink cartridge;

advancing a ram into the chamber toward the outlet passage; and, urging the screen against the ink cartridge adjacent the outlet passage wherein the urging step includes applying a vacuum at the outlet passage to pull the screen in position thereover.

3. The method of claim 2 comprising the further step of recessing a central portion of the ram.

4. A method of assembling an ink cartridge that has a chamber for receiving ink therein and an outlet passage communicating with the chamber through which ink is selectively dispensed, and a screen for filtering ink before the ink passes through the outlet passage, the method comprising the steps of:

locating the screen in overlying relation with the outlet passage;

fusing a portion of the screen in sealing relation to the ink cartridge; and, advancing a ram into the chamber toward the outlet passage wherein the advancing step includes contacting the screen with the ram along a peripheral portion.

* * * * *